US006427300B2

(12) United States Patent
Naito et al.

(10) Patent No.: US 6,427,300 B2
(45) Date of Patent: Aug. 6, 2002

(54) YARN RELAXATION-HEATING METHOD AND APPARATUS THEREFOR

(75) Inventors: Shunzo Naito; Takashi Ikeuchi; Tetsuya Watanabe, all of Ehime (JP)

(73) Assignee: Teijin Seiki Co., Ltd., Tokyo (JP)

( * ) Notice: Subject to any disclaimer, the term of this patent is extended or adjusted under 35 U.S.C. 154(b) by 0 days.

(21) Appl. No.: 09/813,388

(22) Filed: Mar. 21, 2001

Related U.S. Application Data

(63) Continuation of application No. PCT/JP00/04855, filed on Jul. 19, 2000.

(30) Foreign Application Priority Data

Jul. 23, 1999 (JP) ..... 11-208970

(51) Int. Cl.[7] ..... D02J 1/22
(52) U.S. Cl. ..... 28/240
(58) Field of Search ..... 57/205, 285, 283, 57/290, 287, 289, 240; 28/240, 249

(56) References Cited

U.S. PATENT DOCUMENTS 3,221,385 A * 12/1965 Stanley ..... 28/72
3,790,995 A * 2/1974 Martin et al. ..... 28/59.5
3,803,674 A * 4/1974 Seem et al. ..... 28/62
3,968,638 A * 7/1976 Norton ..... 57/140 R
4,086,751 A * 5/1978 Hino et al. ..... 57/157 TS
4,452,160 A * 6/1984 Tajiri et al. ..... 112/410

FOREIGN PATENT DOCUMENTS

| | | | |
|---|---|---|---|
| JP | 60-9979 | U | 1/1985 |
| JP | 63-165513 | A | 7/1988 |
| JP | 2-42075 | U | 3/1990 |
| JP | 5-98530 | A | 4/1993 |
| JP | 6-322625 | A | 11/1994 |
| JP | 7-34338 | A | 2/1995 |
| JP | 8-120533 | A | 5/1996 |
| JP | 10-331040 | A | 12/1998 |

OTHER PUBLICATIONS

Fiber Producer, "Speetex STM25", American Barmag Corporation, Aug. 1979.

* cited by examiner

*Primary Examiner*—Rodney M. Lindsey
*Assistant Examiner*—James G Smith
(74) *Attorney, Agent, or Firm*—Akin, Gump, Strauss, Hauer & Feld, L.L.P.

(57) ABSTRACT

In a relaxation-heating method and an apparatus therefor, relaxation-heating is performed by a heating apparatus which is provided between a yarn supply roller (5) and a take-up roller (7) having a speed lower than that of the supply roller (5) and which is constituted by a heating roller (6*a*) and an auxiliary bobbin (6*b*). In the relaxation-heating method and an apparatus therefor, the size is compact, the heat conductivity is high and yarn can be made to run at a high speed.

3 Claims, 2 Drawing Sheets

YARN RELAXATION-HEATING METHOD AND APPARATUS THEREFOR

CROSS-REFERENCE TO RELATED APPLICATION

This application is a continuation of International Application No. PCT/JP00/04855 filed Jul. 19, 2000 the disclosure of which is incorporated herein by reference.

BACKGROUND OF THE INVENTION

The present invention relates to a yarn relaxation-heating method and an apparatus therefor. More particularly, the present invention relates to a yarn relaxation-heating method and a yarn relaxation-heating apparatus for use in false-twisting thermoplastic synthetic fiber such as polyester fiber, polyamide fiber, etc.

Heretofore, in false-twisting or rolling and false-twisting of such synthetic fiber, a so-called first heater which is a heating apparatus for false-twisting and fixation, and a so-called second heater which is a heating apparatus for performing relaxation-heating of yarn to improve thermal size stability to obtain low-stretchable false-twisted yarn are used as disclosed in JP-A-5-98530, JP-A-6-322625, JP-A-7-34338, JP-A-8-120533 or JP-A-10-331040.

In the second heater, heretofore, a non-contact grooved heater or a pipe heater is provided between a yarn supply roller (feed roller) and a take-up roller having a speed lower than that of the supply roller in order to perform relaxation-heating (contractive heating).

In a relaxation-heating apparatus using the background-art second heater, the temperature of the contact type pipe heater is limited to 230° C. at the maximum. Moreover, it is necessary to make the pipe heater long for high-speed treatment. Hence, there is a problem that contact resistance becomes high. On the other hand, the high-temperature non-contact type grooved heater is poor in heat conductivity because the heater is of the non-contact type. Hence, the heater becomes long. Further, the temperature of a heating plate cannot but be made high. Moreover, there are various problems that heating spots are caused by swinging of yarn running at a high speed or caused by distortion of the yarn by the torque.

The present invention is designed in consideration of such problems and provides a relaxation-heating method and an apparatus therefor, in which the size is compact, the heat conductivity is high, and yarn can be made to run at a high speed.

Incidentally, JP-U-60-9979 discloses a rolling and heating apparatus having a heating roller and a separate roller opposite to the heating roller. The heating roller has a roller diameter which is increased linearly in a longitudinal direction from the yarn input side toward the yarn output side, and has a temperature gradient so that the surface temperature of the roller is increased from the yarn input side toward the yarn output side. Further, U.S. Pat. No. 3,803,674 discloses a method and an apparatus for heating thermoplastic yarn. The apparatus has, for example, two rollers (68, 69) separated from each other.

As means for solving the aforementioned problem, the method according to the present invention has a feature in which relaxation-heating is performed by a heating apparatus which is provided between a yarn supply roller and a take-up roller having a speed lower than that of the supply roller, the heating apparatus being constituted by a heating roller and an auxiliary bobbin.

BRIEF SUMMARY OF THE INVENTION

Further, the apparatus according to the present invention is has a feature in that the apparatus is provided with a yarn supply roller, a take-up roller having a speed lower than that of the supply roller, and a heating apparatus provided between the take-up roller and the supply roller and constituted by a heating roller and an auxiliary bobbin. As a result, the apparatus is compact in size and high in heat conductivity. Further, the apparatus can prevent occurrence of various heating spots which are generated by the running of yarn. Other features, operations and effects of the present invention will be described in detail in the following disclosure.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

The present invention will be described below in detail on the basis of a preferred embodiment of the present invention.

Figure 1:
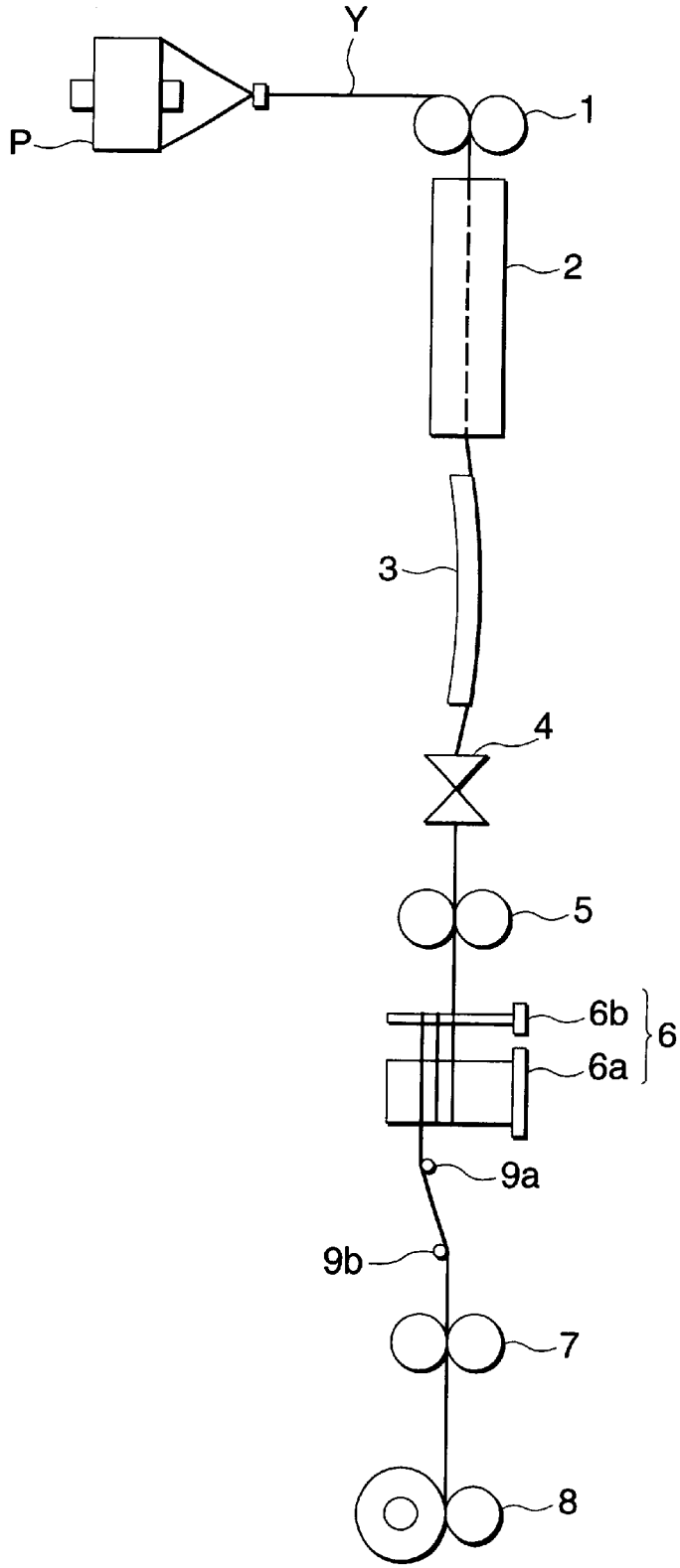
FIG. 1 is a typical flow diagram of a rolling and false-twisting apparatus using a first embodiment of a heating apparatus according to the present invention.

FIG. 1 is a typical flow diagram of a rolling and false-twisting apparatus using an embodiment of an apparatus according to the present invention. In FIG. 1, the reference numeral 1 designates a first feed roller for taking up yarn Y while relaxing yarn Y from a yarn package P. The reference numeral 2 designates a first heater; 3, a cooling plate; and 4, a false twister for giving false twist to the yarn Y. The reference numeral 5 designates a second feed roller for taking up the yarn at a speed higher than the yarn feed seed of the first feed roller 1 and for rolling the yarn Y.

The reference numeral 6 designates a second heater (which will be described later in detail); and 7, a third feed roller. The third feed roller 7 takes up, at a speed lower than the speed of the second feed roller 5, the yarn delivered from the second feed roller 5 after the yarn is relaxation-heated by the second heater 6. The third feed roller 7 delivers the yarn to a winder 8.

A so-called rolling and false-twisting apparatus, which is constituted by the first feed roller 1, the first heater 2, the cooling plate 3, the false twister 4, the second feed roller 5, the second heater 6, the third feed roller 7 and the winder 8, is a known means for obtaining low-shrinkage false-twisted yarn by the second heater system. The rolling and false-twisting apparatus is heretofore well-known and the detailed description of this mechanism will be omitted.

The second heater 6 includes a heating roller 6*a*, and a free rotation roller 6*b* (also called separate roller) which is an auxiliary bobbin. Yam Y is wound so as to circumscribe the heating roller 6*a* and the free rotation roller 6*b* (see FIG. 2(*a*)). The inclination of the free rotation roller 6*b* to the heating roller 6*a* is adjusted so as to adjust the pitch d of the wound yarn Y to thereby adjust the number of turns of the yarn, that is, the contact length of the yarn with the heating roller 6*a*.

The second feed roller 5, the second heater 6 and the third feed roller 7 constitute a yarn relaxation-heating apparatus described in the present invention. The second feed roller 5 is equivalent to a supply roller. The heating roller 6*a* and the auxiliary bobbin 6*b* constitute a heating apparatus. The third feed roller 7 is equivalent to a take-up roller.

As described above, in the relaxation-heating apparatus according to the present invention, yarn is heated in the condition that the yarn is wound so as to circumscribe the heating roller 6*a* and the auxiliary bobbin 6*b*. Hence, heating efficiency is so high that high-speed treatment can be made because the heating is direct-contact heating. Moreover, the running of the yarn is stable because it is contact-running. Hence, there occurs no heating spot due to running spots caused by the distortion of the false-twisted yarn by the torque or caused by swinging of the yarn. Moreover, the contact length of the yarn with the heating roller can be set at option. In other words, the number of turns of the yarn can be set at option. Hence, the heating condition can be widened widely, and the relaxation-heating condition can be diversified.

The yarn slides between the heating roller 6*a* and the auxiliary bobbin 6*b* to thereby absorb divergence or looseness involved in contraction of the yarn. To make the absorption of contraction smoother, the heating roller may be tapered off to thereby effectively reduce the yarn feed speed in accordance with heating. Moreover, to make the contraction sliding of the yarn smoother, the surface of the roller may be subjected to so-called matte-finishing to thereby reduce frictional resistance.

The percentage of taper of the heating roller is preferably selected in consideration of the percentage of over-feed. When, for example, the ratio of the second feed roller speed to the third feed roller speed is 100:95 and the yarn is wound onto the heating roller by a plurality of turns, the contraction of the yarn on the heating roller can be absorbed ideally if the ratio of the diameter at a portion corresponding to the first turn to the diameter at a portion corresponding to the last turn is selected to be 100:95.

It is effective that the relaxation-heating apparatus according to the present invention is used with the percentage of over-feed in a range of from 5% to 10% which is higher than that in an ordinary high-speed type rolling and false-twisting apparatus. If the percentage of over-feed is higher than the aforementioned range, swinging of yarn or heating spots are apt to occur. If the percentage of over-feed is lower than the aforementioned range, it is difficult to reduce the percentage shrinkage. In a general-purpose machine used with the change of the percentage of over-feed, it is easy to adapt the machine to various conditions if the taper is selected so that the diameter at the portion corresponding to the last turn is smaller by 5–7% than the portion corresponding to the first turn. Further, the percentage of taper may be increased/reduced slightly more than the over-feed ratio in consideration of the frictional resistance of the ordinary auxiliary bobbin, or the like.

Figure 2A:
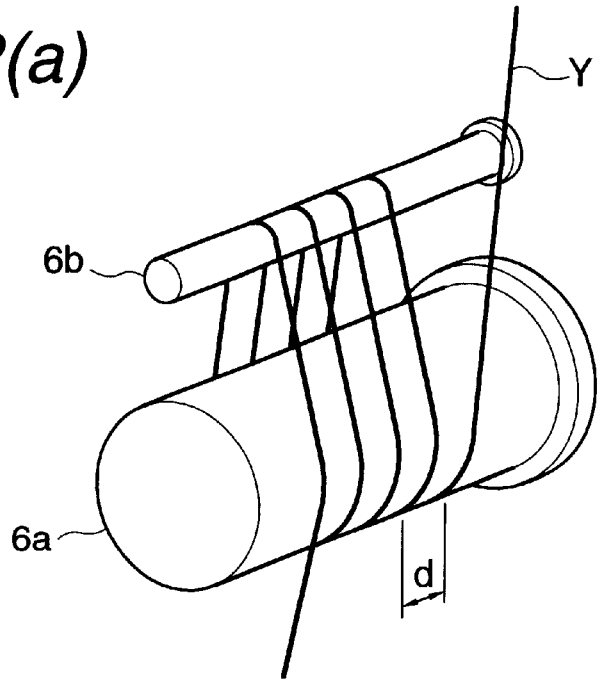
FIG. 2(*a*) is a partly perspective view of a heating roller portion depicted in FIG. 1, and FIG. 2(*b*) is a perspective view of a heating roller portion in another embodiment of the present invention.
Figure 2B:
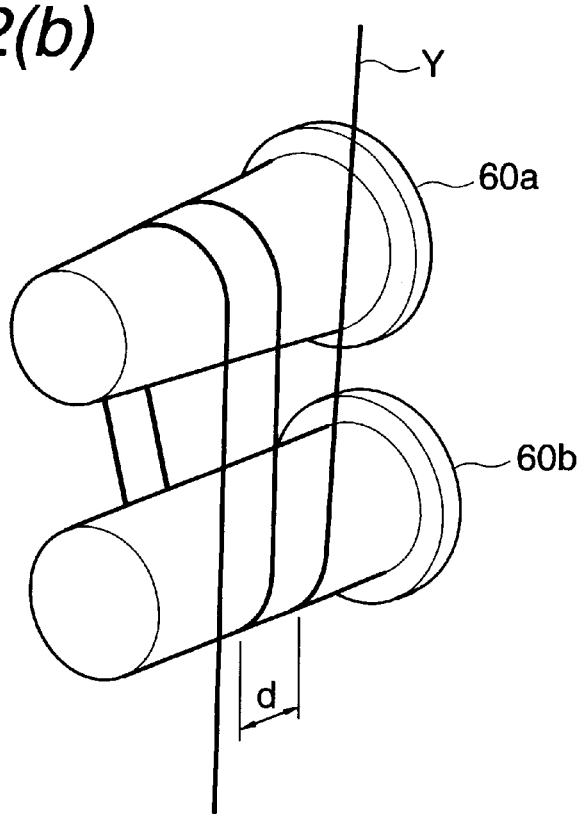

Although the aforementioned embodiment has shown the case where a so-called separate roller is used as the auxiliary bobbin, the auxiliary bobbin may be constituted not by a rotation roller but by a non-rotation yarn guide. Alternatively, in place of the auxiliary, a pair of heating rollers may be provided as shown in FIG. 2(*b*). In this case, yarn is heated while running in the condition that the yarn is wound so as to circumscribe the pair of heating rollers 60*a* and 60*b*. Although FIG. 2(*b*) shows the case where the heating roller 60*a* is tapered off, both the rollers may be tapered off or both the rollers may be straight rollers as occasion demands.

EXAMPLE

An example of yarn relaxation-heating process by using the apparatus of FIG. 1 will be described below.

(1) Factors of Heating Apparatus used
- Heating Roller Diameter 100 mmø(straight roller)
- Length 85 mm
- Surface Temperature 140–230° C. (variable)

(2) Yarn Treating Condition

A. False Twisting Condition
- Namepolyester yarn 150 D (denier)/30 (single yarn)
- Draw Ratio 1.56
- First Heater Temperature (vertical separate type) upper portion temperature 500° C., lower portion temperature 390° C.
- Treating Speed 900 m/min
- False Twisting System triaxial friction disk system (composed of eight disks inclusive of upper and lower guide disks)

B. Relaxation-Heating Condition
- Surface Temperature 160° C.
- Percentage of over-feed 5%
  - (second feed roller speed/third feed roller speed=100/95)
  - (second feed roller speed/heating roller speed=100/97.5)
- Contact Length, the number of turns 4

(3) Treating Result
- Quality of Treated Yarn

Uniform low-shrinkage false-twisted yarn with a percentage of shrinkage of 10.5% was obtained. The percentage of shrinkage was obtained on the basis of measurement of the draw ratio of picked-up yarn after the picked-up yarn was boiled in boiling water and then dried.

(In a background-art heater, local defects, that is, so-called tight spots were produced at high-temperature relaxation-heating. At such a treating temperature that such tight spots are not produced, the percentage of shrinkage was limited to 17.9% at the maximum).

INDUSTRIAL APPLICABILITY

The present invention can be applied to a yarn relaxation-heating method and an apparatus therefor. More specifically, the present invention can be applied to a yarn relaxation-heating method and a yarn relaxation-heating apparatus for use in false-twisting thermoplastic synthetic fiber such as polyester fiber, polyamide fiber, etc. Relaxation-heating is performed by a heating apparatus which is provided between a yarn supply roller and a take-up roller having a speed lower than that of the supply roller and which is constituted by a heating roller and an auxiliary bobbin. Hence, heating efficiency is so high that high-speed treatment can be made because the heating is direct-contact heating. Hence, the apparatus can be made compact. Moreover, the running of the yarn is stable because the running is contact running. Hence, there occurs no heating spot due to running spots caused by distortion of the false-twisted yarn by the torque or caused by swinging of the yarn. Moreover, the contact length of the yarn with the heating roller can be set at option. In other words, the number of turns of the yarn can be set at option. Hence, the heating condition can be widened largely, so that the relaxation-heating condition can be diversified.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A yarn relaxation-heating apparatus characterized in that said apparatus comprises a yarn supply roller, a take-up roller having a speed lower than that of said supply roller, and a heating apparatus provided between said take-up roller and said supply roller comprised of a tapered-off heating roller and a freely rotating auxiliary bobbin.

2. A yarn relaxation-heating apparatus characterized in that said apparatus comprises a yarn supply roller, a take-up roller having a speed lower than that of said supply roller, and a heating apparatus provided between said take-up roller and said supply roller comprised of a pair of heating rollers including at least a freely rotating auxiliary bobbin wherein at least one of said heating rollers is a tapered-off roller.

3. A yarn relaxation-heating method comprising the steps of:

a) drawing yarn from a yarn supply roller at a predetermined speed;

b) drawing the yarn through a first heater to heat set the yarn;

c) drawing the yarn over a secondary heater comprised of a tapered-off heating roller and a freely rotating auxiliary bobbin that transforms the yarn into a relaxation state; and d) drawing the yarn to a take-up roller wherein the speed of the take-up roller is less than the predetermined speed.

* * * * *